United States Patent [19]

Takano et al.

[11] Patent Number: 4,909,207

[45] Date of Patent: Mar. 20, 1990

[54] CLEANING SYSTEM FOR FUEL INJECTORS

[75] Inventors: Toshio Takano, Yokohama; Keiichi Shindo, Tokyo; Yasuhiro Iwata, Yokohama; Masamitsu Higuchi, Hiratsuka; Hidehiro Nishizawa, Hiratsuka; Atsushi Fujimoto, Hiratsuka, all of Japan; Hidehiro Nishizawa, both of Hiratsuka, all of Japan

[73] Assignee: Nissan Motor Company, Limited, Yokohama, Japan

[21] Appl. No.: 228,704

[22] Filed: Aug. 5, 1988

Related U.S. Application Data

[63] Continuation of Ser. No. 393,592, Jun. 30, 1982, abandoned.

[30] Foreign Application Priority Data

Jul. 3, 1981 [JP] Japan ..... 56-103343

[51] Int. Cl.[4] ..... B08B 3/08

[52] U.S. Cl. ..... 123/198 A; 134/20; 252/171

[58] Field of Search ..... 123/198 A, 1 A, 25 G; 134/123, 169 A, 19, 20, 39; 252/171

[56] References Cited

U.S. PATENT DOCUMENTS

| | | | |
|---|---|---|---|
| 1,924,722 | 8/1933 | Louell et al. | 123/198 A |
| 2,201,774 | 5/1940 | Hofele | 123/198 A |
| 2,641,267 | 6/1953 | Faulkner | 123/198 A |
| 3,779,213 | 12/1973 | Knudsen | 123/198 A |
| 4,059,123 | 11/1977 | Bartos et al. | 134/169 A |
| 4,167,193 | 9/1979 | Magnus et al. | 123/169 A |
| 4,197,140 | 4/1980 | Swan | 123/198 A |
| 364,331,121 | 5/1982 | Stokes | 123/198 A |
| 4,520,773 | 6/1985 | Koslow | 123/198 A |
| 4,606,311 | 8/1986 | Reyes et al. | 123/198 A |

FOREIGN PATENT DOCUMENTS

| | | | |
|---|---|---|---|
| 652338 | 3/1979 | U.S.S.R. | 123/198 A |
| 723359 | 3/1980 | U.S.S.R. | 123/198 A |

*Primary Examiner*—Noah P. Kamen

*Attorney, Agent, or Firm*—Foley & Lardner, Schwartz, Jeffery, Schwaab, Mack, Blumenthal & Evans

[57] ABSTRACT

Cleaning of gums, sludge and other adhering on a fuel injection valve in a fuel injection internal combustion engine can be done by driving of engine with a cleaning agent as a mixture of gasoline and an aromatic solvent. The mixture is adjusted the mixture rate thereof to satisfactorily combustion in an engine cylinder and dissolve gums, sludge and other adherings on the fuel injection valve. The cleaning agent is supplied to the engine cylinder through the fuel injection valve and during passing through the fuel injection valve it dissolves the adherings.

3 Claims, 11 Drawing Sheets

CLEANING SYSTEM FOR FUEL INJECTORS

This application is a continuation of application Ser. No. 393,592, filed June 30, 1982 now abandoned.

BACKGROUND OF THE INVENTION

The present invention relates generally to a method and a device for solvent cleaning of a fuel injection valve in a fuel injection system of an internal combustion engine. More particularly, the invention relates to a fuel injection valve cleaning method and device which is capable of cleaning up the fuel injection valve without taking it off from the engine cylinder block. The invention further relates to a cleaning agent applicable for the method and the device.

In a fuel injection internal combustion engine, gums, sludge and so on are apt to adhere on the fuel injection valve by using gasoline composing of a high rate of lead, surfur and so on and subjecting same to recirculated exhaust gas. The adhering gums, sludge and so on will narrow the fuel passage and result in a drop in engine performance. In order to maintain good engine performance high or to recover lost engine performance, it is necessary to clean up the gum, sludge and so on adhering to the fuel injection valve.

Conventionally, the fuel injection valve is replaced with a new one or previously cleaned one. In this procedure it is necessary to take out the fuel injection valve from the engine assembly. To take out the fuel injection valve, the fuel injection assembly including the fuel pipe, connector, harness and so on must be also taken out. Since the fuel injection assembly has a complicated structure and is difficult to be taken out, the disassembling operation itself is substantially difficult and takes a remarkably long time. Furthermore, the fuel injection valve as a replacement part is rather expensive and makes replacing the fuel injection valve quite expensive.

SUMMARY OF THE INVENTION

Therefore, it is an object of the present invention to provide a method for solvent cleaning of a fuel injection valve, which is capable of cleaning the fuel injection valve without taking it out from the engine block.

Another object of the invention is to provide a device for performing the cleaning method of the present invention, in which a cleaning agent is introduced into a fuel supply circuit under actual engine driving conditions.

A further object of the invention is to provide the cleaning agent applicable for the method and device of the invention, which cleaning agent is combustible in the engine cylinder and is capable of cleaning adhering gums, sludges and so forth on the fuel injection valve.

In order to accomplish the above-mentioned and other objects, there is provided a method for cleaning up the fuel injection valve, in which a combustible cleaning agent is supplied to an engine combustion chamber through the fuel injection valve. During injection through the fuel injection valve, gums, sludges and other adhesions on the fuel injection valve are dissolved into the cleaning agent and burnt with the cleaning agent in the combustion chamber.

To perform the above-mentioned method and to accomplish the other objects, a fuel injection valve cleaning device, according to the present invention, comprises a cleaning agent supply circuit which includes a source of the cleaning agent and a cleaning agent feed pipe releasably connected to an appropriate portion of a fuel supply circuit. Preferably, the device is provided with a valve for blocking the fuel flow while the cleaning agent is supplied.

The cleaning agent is a mixture of a gasoline and aromatic solvent, which mixture is combustible in the engine cylinder and adapted for solvent cleaning of gums, sludges and so forth adhering on the fuel injection valve. In order to obtain satisfactory solvent cleaning effect and successful combustion in the combustion chamber, mixture ratio of the gasoline vis-a-vis aromatic solvent is about 6–18:1. Preferably, the aromatic solvent comprises organic fatty acid, calcium-sulfonate butyl-cellosolve and, aromatic hydrocarbon. The aromatic solvent is mixed with a water at a ratio about 70 volume percent vis-a-vis 30 volume percent.

BRIEF DESCRIPTION OF THE DRAWINGS

The present invention will be understood more fully from the detailed description given herebelow and from the accompanying drawings of the preferred embodiments of the present invention, which, however, should not be taken as limitative to the invention but for elucidation and explanation only.

In the drawings:

FIG. 4 is an illustration of the outer surface of a fuel injection valve in a condition before the cleaning operation and therefore adhering gums, sludge and so on;

FIGS. 8 to 11 are photograph of the fuel injection valve, the photographs are sketched in FIGS. 4 to 7 as set forth;

DETAILED DESCRIPTION OF THE PREFERRED EMBODIMENTS

Figure 1:
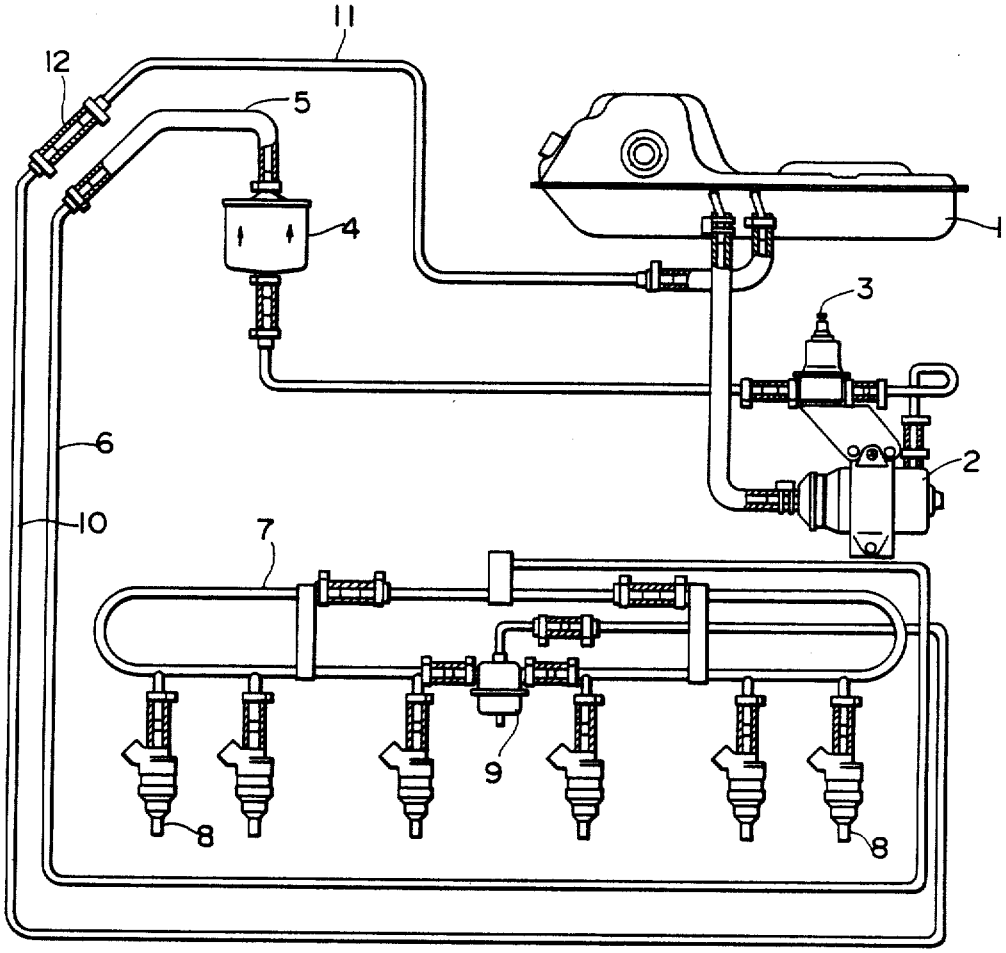
FIG. 1 is a diagrammatic illustration showing a fuel supply system for an electronically controlled fuel injection system.

Referring now to the drawings, particularly to FIG. 1, there is shown a typical fuel supply circuit in an electronically controlled fuel injection system for a gasoline injection type internal combustion engine. A fuel tank 1 is connected to a fuel pump 2 via a fuel feeding tube.

The fuel pump 2 is in turn connected to a fuel damper 3 and a fuel filter 4. The fuel filter 4 is connected to fuel injection valves 8 through a hose 5, a fuel feeding pipe 6 and a gallery 7. A pressure regulator 9 is connected to the gallery 7 to return remaining fuel to the fuel pump via a return pipe 10, a hose 12 and a return pipe 11.

The fuel in the fuel tank 1 is sucked into the fuel pump 2. The fuel pump 2 circulates the fuel through the fuel supply circuit. A fuel damper 3 receives the fuel and absorbs the pulsating flow thereof thereby smoothing out the fluid flow. The fuel is then fed to the fuel filter 4 for taking out undesirable intermixtures, such as dust, and then to the fuel injection valves 8 via a fuel feeding circuit constituted by the hose 5, the fuel feeding pipe 6 and the gallery 7. The fuel injection valves 8 include actuators for opening and closing thereof, which actuators are respectively controlled by an electronic controller, such as a microcomputer. The remaining fuel is fed to the pressure regulator 9 and fed back to the fuel tank 1 via the fuel return circuit including the return pipes 10 and 11 and the hose 12. Such fuel supply system has been illustrated in Technical Explanation "50 Model Electronically Controlled Fuel Injection System", June, 1976, published by Nissan Motor Company Limited. The above referred publication is incorporated herein by reference.

Figure 2:
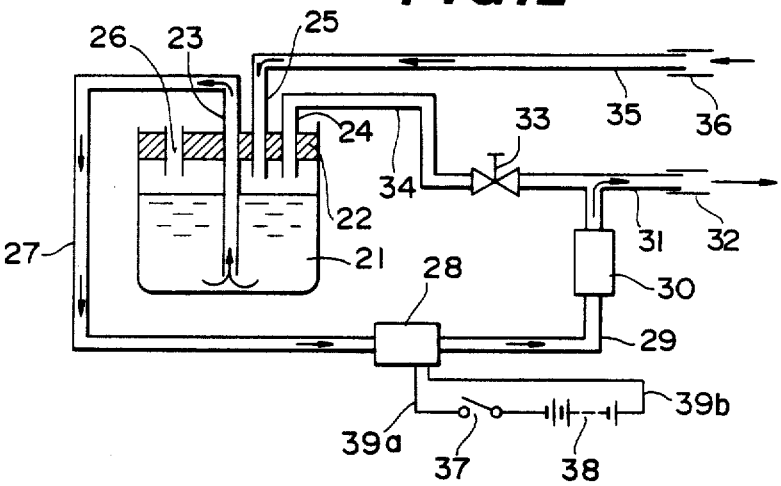
FIG. 2 is a schematic circuit diagram of the first embodiment of cleaning device according to the present invention.
Figure 3:
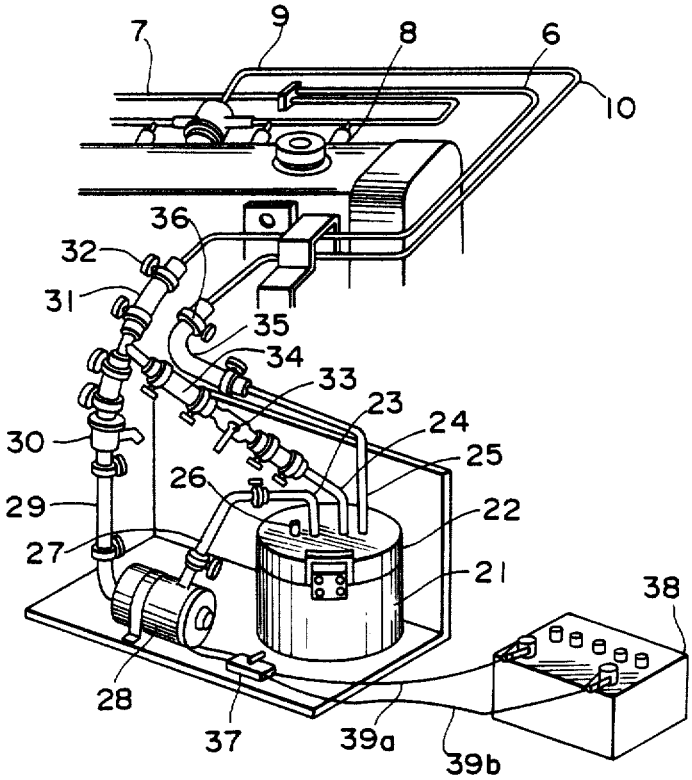
FIG. 3 is a perspective view of the cleaning device of FIG. 2, which cleaning device has been illustrated in a position applied to the engine for cleaning operation.
Figure 4:
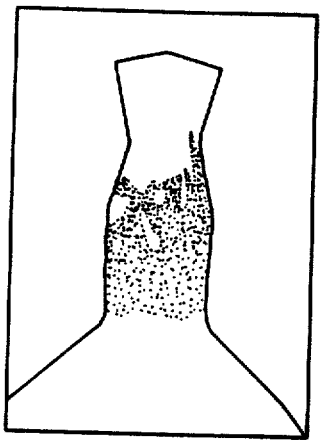
Figure 5:
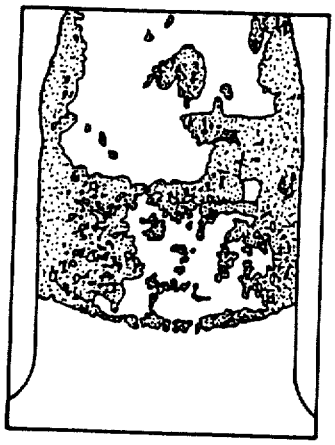
FIG. 5 is an enlarged illustration of the outer surface of the fuel injection valve showing detail of FIG. 4.
Figure 6:
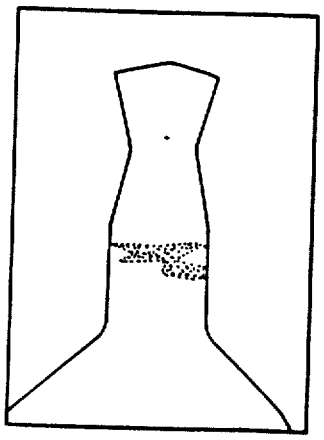
FIG. 6 is an illustration similar to FIG. 4 but showing the outer surface of the fuel injection valve after cleaning.
Figure 7:
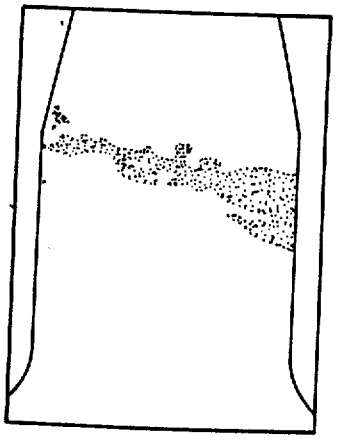
FIG. 7 is an enlarged illustration similar to FIG. 5 but showing detail of FIG. 6.
Figure 4:
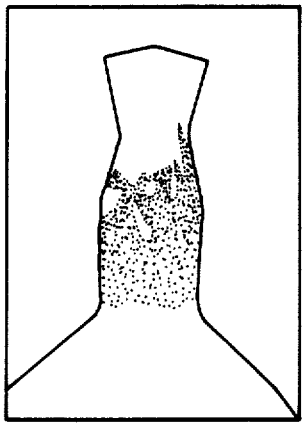
Figure 5:
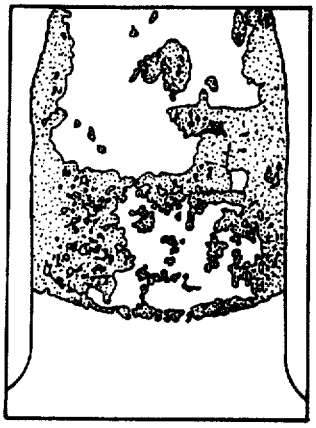
Figure 6:
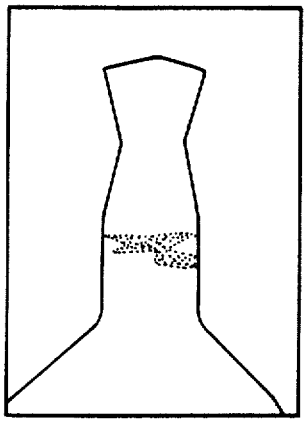
Figure 7:
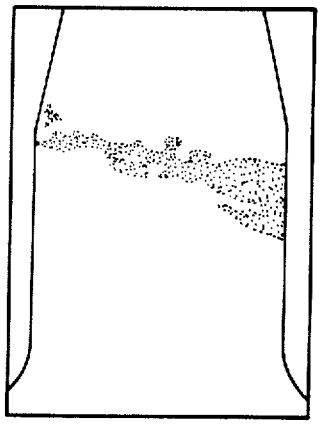

In the first embodiment of the present invention, a solvent cleaning device is joined with the fuel supply system for feeding a cleaning agent to the combustion chambers of the engine through the fuel injection valve, as shown in FIGS. 2 and 3. The cleaning agent dissolves gums, sludges and so on adhering on the fuel injection valve while it passes therethrough. The solvent cleaning device of the embodiment shown includes a reservoir tank 21 for storing the cleaning agent, an electric pump 28, a cleaning agent feeding circuit and a cleaning agent returning circuit.

The electronic pump 28 is driven by a vehicle battery 38 or other appropriate power source connected thereto via conductive lines 39*a*, 39*b* and a switch 37. The electric pump 28 is connected to a suction pipe 27 having one end inserted into the reservoir tank 21 through an opening of a closure 22 and positioned adjacent the bottom of the tank. In turn, the electric pump 28 is connected to the fuel feeding circuit of the fuel supply system via the cleaning agent feeding circuit. Likewise, the cleaning agent returning circuit is connected to the fuel return circuit. The end of the cleaning agent returning circuit is inserted into the tank 21 via an opening of the closure 22. For the closure 22 of the reservoir tank 21, there is provided an air pipe 26 for communication of air between interior and exterior of the tank.

The cleaning agent feeding circuit comprises a tube 29 one end of which is connected to the electric pump 28 and the other end is connected to a filter 30. A feed tube 31 is connected to the filter 30 at one end. The other end of the feed tube 31 is connected to the fuel feeding circuit via a clamper or one-touch coupler 32. In the embodiment shown, the feed tube 31 is connected to the fuel feeding pipe 6. The feeding tube 31 has a branch circuit branched at an intermediate portion thereof. The branched circuit has the end inserted into the reservoir tank 21 through the opening of the closure 22. The branch circuit includes a pressure relief cock valve 33 connected to the feeding tube 31 via a relief tube 34. The pressure relief cock valve 33 is, in turn, connected to the reservoir tank 21 via a tube 24.

On the other hand, the cleaning agent returning circuit comprises a return tube 25. One end of the return tube 25 is inserted into the tank and the other end is connected to the fuel returning circuit via a clamper or one-touch coupler 36. In the preferred construction, the end of the return tube 25 is connected to a tube 10 in the fuel returning circuit.

The cleaning agent is a mixture of gasoline as the fuel of the engine and additives for solvent cleaning. The additives are generally composed of 75–60 volume percent aromatic solvent and 15–40 volume percent of water. The aromatic solvent and water must be well homogenized. The aromatic solvent composes a several volume percent of fatty acid, several volume percent of calcium-sulfonate, about 10 volume percent of butylcellosolve and the remaining volume percent of aromatic hydrocarbon. The solvent additive is mixed with the gasoline at a mixture rate 1:6–18.

For performing solvent cleaning of the fuel injection valve, at first, the fuel feeding system must be treated so that it becomes inoperative to feed the fuel to the engine. Therefore, the driving circuit of the fuel pump 2 is broken at a harness coupler or pump relay terminal. The hoses 5 and 12 in the fuel feeding circuit and the fuel returning circuit are taken out from the circuits for disconnecting between the filter 4 and the feeding tube 6 and return tubes 10 and 11. The hoses 5 and 12 maintain connection respectively with the filter 4 and the tube 11. Plugs are applied to the end of hoses 5 and 12 which are released from the tubes 6 and 11 respectively.

In case of cleaning the fuel injection valves in an internal combustion engine having a choke valve, the foregoing treatment must be performed after warming up to prevent the cleaning agent from flowing through the choke valve.

Then, the cleaning agent feeding circuit and return circuit are connected to the fuel feeding and returning circuit. In practice, the feed tube 31 of the cleaning agent feeding circuit is connected to the fuel feed tube 6 via the coupler 32 and the return tube 25 of the cleaning agent return circuit is connected to the fuel return tube 10. The conductive lines 39*a* and 39*b* are connected to the vehicle battery 38. At this time, the switch 37 of the electric pump drive circuit is maintained at the off position and the pressure relief cock valve 33 is closed. Also, the reservoir tank 21 is filled with the cleaning agent. The cleaning agent in the tank 21 must be well mixed so that the gasoline and the solvent additive form a homogeneous mixture.

In operation the switch 37 is turned on to drive the electric pump 28. Thus, the cleaning agent in the reservoir tank 21 is sucked through the suction pipe 27 and fed to the electric pump 28. The cleaning agent is energized by the electric pump 28 to be supplied to the fuel injection valve via the tube 29, the filter 30, the feeding tubes 31 and 6 and the gallery 7. Remaining cleaning agent is fed back to the reservoir tank 21 via the pressure regulator 9, the return tubes 10 and 25. In this condition, the ignition switch (not shown) of the engine is turned on to drive the engine. The engine speed should be maintained at about 2,000 r.p.m. for about 10 min. under a no load condition.

In this manner, the cleaning agent passes through the fuel injection valve 8 at a controlled amount everytime the fuel injection valve is opened. The cleaning agent which passing through the fuel injection valve dissolves gums, sludges and so forth adhering on the fuel injection valve and is then burnt in the engine combustion chamber It is considered that the aromatic hydrocarbon in the cleaning agent helps combustion in the combustion chamber and the fatty acid and calcium-sulfonate are effective for dissolving gums, sludges and so forth. Also, the water in the cleaning agent is considered to aid dissolving and washing the gums sludge and so on. Butyl-cellosolve is useful as the solvent of the aromatic solvent and the water.

The driving duration of the engine is selected to consume the cleaning agent at about 1 to 1.5.1. for cleaning up the fuel injection valves. However, this duration must be variable depending on the number of the fuel injection valves and the size of the engine. Further, the driving duration of the engine must be varied depending upon the mixture rate of the gasoline and solvent additive in the cleaning agent. In one experiment, the ratio of the mixture solvent additive to gasoline was 1:12, and the mixture was used as the cleaning agent. The engine was 2800 cc with 6-cylinders known as L-28 engine of Datsun.

After 10 min., the ignition switch is turned off to stop the engine, and the switch 37 is also turned off to stop the electric pump 28. Then, the cleaning agent in the reservoir tank 21 is drained and gasoline is filled in the tank. Here, the switch 37 is again turned on to supply gasoline to the fuel injection valve 8. The ignition switch is also turned on to drive the engine. In this manner, the cleaning agent remaining in the fuel supply system and the induction passage of the engine is completely burnt. This process is intended to prevent the fuel supply system and the engine from being corroded by the remained cleaning agent.

The engine speed is kept at approximately 2,000 r.p.m. for 10 min. under no a load condition. Then, the ignition switch is turned off and the switch 37 is also turned off.

It should be appreciated that the process for completely clearing the remained cleaning agent is not always required and, therefore, can be neglected if unnecessary. In case the engine will be driven to drive the vehicle immediately after the cleaning operation, it would be unnecessary to perform the cleaning process.

Then, the cleaning agent device is taken off. At first, the conductive lines **39*a* and 39*b* are released from the vehicle battery terminal. The pressure relief cock value is then opened to drop the pressure in the cleaning agent feeding circuit. After about 10 sec. after the pressure relied cock valve 33 is opened, the feed tube 31 and the return tube 35 are respectively taken off from the fuel feeding tube 6 and the fuel returning tube 10 in the fuel feeding circuit. At the same time, fuel in the reservoir tank 21 and the cleaning agent feeding circuit is drained. Thereafter, the fuel feeding tube 6 is connected to the fuel cleaner 4 with the hose 5 and the fuel returning tube 10 is connected to the return tube 11**. Thus, the fuel feeding circuit is completed. Also, the harness coupler or pump relay terminal released upon assembling the cleaning device is engaged.

Hereafter, the result of experimental cleaning operation will be described with reference to FIGS. 4 to 11. As will be seen herefrom, FIGS. 8 to 11 are photoprint showing the effect of the cleaning operation made in use with the cleaning device according to the foregoing embodiment of the present invention. For clarity, FIGS. 4 to 7 show sketches of the photographs of FIGS. 8 to 11. In this experiment a 2,800 cc, 6-cylinder fuel injection internal combustion engine, the so-called Datsun L-28E engine, was driven about 5,000 km in city driving. Before the cleaning operation, the condition of the fuel injection values are as illustrated in FIGS. 4, 5 and 8, 9. In this condition, surge, backfire, and stalling occurs when the engine speed is under approximately 1,500 to 1,700 r.p.m. Further, the concentration of carbon monoxide and carbon dioxide in the exhaust is 10.84% wherein the desirable concentration is approximately 15%. It is assumed that, when gums, sludge and so forth adhere on the fuel injection valve, the air/fuel mixture supplied to the combustion chamber of the engine becomes lean to make the ratio of hydrocarbons composed in the mixture smaller than in the normal mixture. On the other hand, after the cleaning operation, surge, backfire, stalling of the engine do not occur in any range of engine speed. Further, the ratio of carbon monoxide and carbon dioxide in the exhaust gas is increased to 14.67% which is approximately the normal (and desired) value. After cleaning, the valve surface of the fuel injection valve is as shown in FIGS. 6, 7 and 10, 11.

By cleaning the values, the fuel injection characteristics are improved as in the table herebelow. In the table, the word "static" means the variation rate of fuel flow amount in relation to a standard flow rate under the condition of the fuel injection valve being maintained at a fully open position and the word "dynamic" means the variation rate of the fuel flow amount in relation to a standard flow rate under the condition of the fuel injection value being moved to an open and closed position as usually occurs in driving the engine. It is estimated that the influence of manufacturing errors of the fuel injection valve for measurement of the static characteristics would be approximately ±3% and for measurement of the dynamic characteristics would be ±6%.

TABLE 1

| Cylinder No. | Before Cleaning | | After Cleaning | |
|---|---|---|---|---|
| | Static | Dynamic | Static | Dynamic |
| 1 | −31.0% | −28.0% | −4.0% | −3.5% |
| 2 | −31.0 | −28.0 | +0.4 | +3.1 |
| 3 | −20.2 | −18.1 | −0.4 | −2.4 |
| 4 | −14.1 | −17.6 | −3.1 | +3.3 |
| 5 | −10.4 | −3.1 | −2.8 | +5.2 |
| 6 | −13.5 | −10.6 | −2.1 | +0.6 |

TABLE 2

| Items | Before Cleaning | After Cleaning |
|---|---|---|
| Static Flow Amount | −32.0 to −10.4% (average −20.2%) | −4.0 to +0.4% (average −2.1%) |
| $CO + CO_2$ (%) | 10.84 | 14.67 |

As will be understood from the table, by cleaning of the fuel injection valve, the fuel flow characteristics in the fuel injection valve becomes or returns to approximately the normal condition. In the foregoing embodiment, the cleaning operation had been performed by manual measurement of the cleaning duration by a worker. It would be appreciated that it would be possible to use a modified system for automatically or semi-automatically controlling the cleaning operation as, for example, by use of a timer. Furthermore, it is possible to use a means for measuring the consumption of the cleaning agent and automatic stopping the cleaning operation at a predetermined cleaning agent consumption amount.

FIGS. 12 to 20 show some of possible modifications of the foregoing embodiment of the present invention. Respective embodiment as the modifications will be described hereafter with reference to the corresponding Figures.

Figure 12:
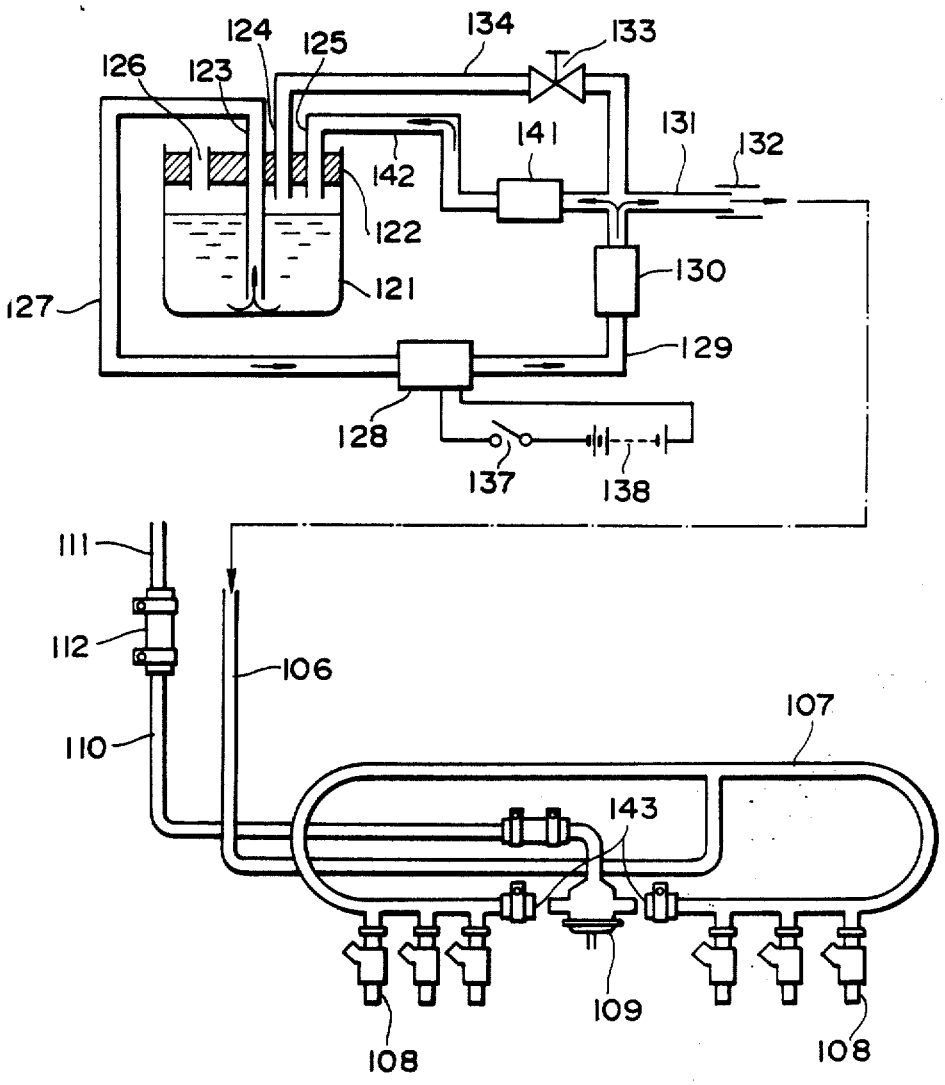
FIG. 12 is a schematic circuit diagram of the second embodiment of the cleaning device according to the present invention.

In FIG. 12, there is illustrated a second embodiment of the cleaning device according to the present invention. In the second embodiment, a common tube is used for feeding and returning the cleaning agent. In the cleaning device of the second embodiment, the reservoir tank 121 to be filled with the cleaning agent is closed by a closure 122 formed with through openings. The suction tube 123 is inserted into the reservoir tank 121 to place the end adjacent the bottom of the tank. The suction tube 123 is connected to the electric pump 128 for energizing the cleaning agent to circulate same through the cleaning agent feeding circuit. The electric pump is connected to the vehicle battery 138 via conductive lines 139*a* and 139*b* and via the switch 137. The electric pump 128 is connected to the filter 130 via the feeding tube 127. The filter 130 is connected to the fuel feeding tube 106 of the fuel feeding circuit via feed tube 131 and the coupler 132. Thus, the cleaning agent is fed to the fuel injection valves 108 via the gallery 107.

As shown in FIG. 12, the gallery 107 is usually connected to the pressure regulator 109; however, it is disconnected from the pressure regulator 109 while the cleaning device of the second embodiment is connected to the fuel feeding circuit. The ends of the gallery 107 is plugged with plugs 143 for stopping the cleaning agent thereat.

The filter 130 is, in turn, connected to the reservoir tank 121 via a return tube 142 with a pressure regulator 141. The filter 130 is further connected to the reservoir tank 121 via pressure relief tube 134 with the pressure relief cock valve 133. Both of the return tube 142 and the pressure relief tube 134 are inserted into the reservoir tank 121 through the through openings of the closure 122. To the closure, another pipe 126 both ends of which are inserted through one of the through openings is provided for establishing communication between the interior and exterior of the tank for equalizing internal and external pressure of the tank.

The pressure regulator 141 includes a bias spring for providing a set pressure thereof. In the embodiment shown, the pressure regulator 141 is adapted to regulate the pressure of the cleaning agent in the feeding circuit at about 2.5 kg/cm$^2$. Therefore, when the cleaning agent pressure in the feeding circuit exceeds as the set pressure, i.e., 2.5 kg/cm$^2$, the extra cleaning agent is returned to the reservoir tank 121 through the return tube 142.

In operation, similarly to the foregoing first embodiment, the electric pump 128 is driven by turning on the switch 37 to feed the cleaning agent to the fuel injection valve. Then, the engine is driven to effect injection of the cleaning agent through the fuel injection valves 108. During passing through the fuel injection valve, the cleaning agent dissolves gum, sludge and so forth as describe in the first embodiment. Thereafter, the cleaning agent including the dissolved gums, sludge and so on is burnt in the combustion chamber of the engine. As set forth, the engine is kept idling at an engine speed of about 2,000 r.p.m. with no load for about 10 min.

After about 10 min. of the cleaning operation, the cleaning agent in the reservoir tank 121 is replaced with gasoline as its normal fuel to remove all of the cleaning agent in the cleaning agent feeding circuit and the fuel feeding circuit. With gasoline, the electric pump 128 and the engine are driven for about 10 min. Afterwhile, the pressure relief cock valve is opened to drop the pressure in the cleaning agent and fuel feeding circuits.

According to the foregoing second embodiment, the pressure regulator in the fuel feeding circuit will not be subject to the cleaning agent. Thus, the pressure regulator 109 is free from corrosion by the cleaning agent.

Figure 13:
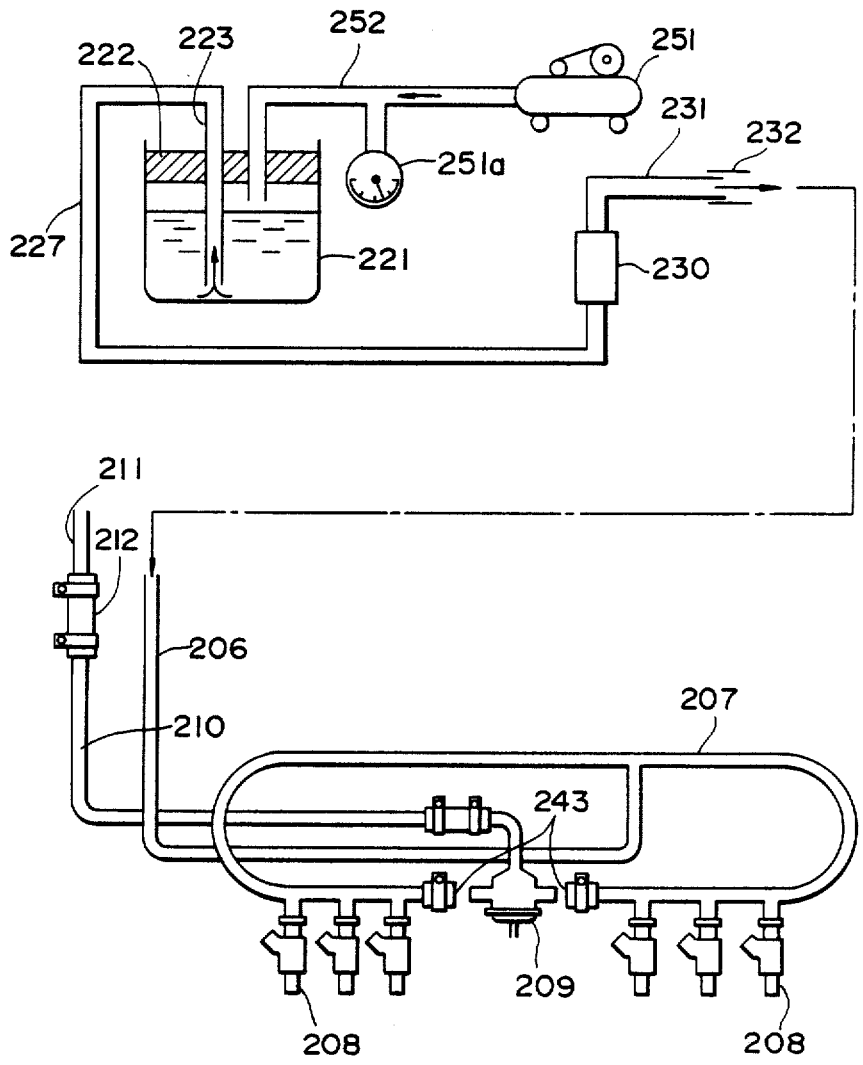
FIG. 13 is a schematic diagram of the third embodiment of the cleaning device.

FIG. 13 shows the third embodiment of the cleaning device according to the present invention. In this embodiment, the cleaning agent feeding system is simplified in use with a compressor 251 instead of the electric pump. As shown in FIG. 13, the reservoir tank 221 filled with the cleaning agent is connected to the compressor 251 through a passageway 52 which has an end inserted into the reservoir tank 221 through the closure 222. The closure is formed with a through opening to receive the end of the passageway 252 and engage therewith in air-tight fashion. The reservoir tank 221 is, in turn, connected to the filter 230 via the cleaning agent feeding tube 227. The cleaning agent feeding tube 227 has one end inserted into the reservoir tank 221 adjacent the bottom thereof. The cleaning agent feeding tube 227 engages with a through opening formed in the closure 222. By this, the interior of the tank is blocked off from communication with the exterior thereof.

The compressor 251 is associated with a pressure gauge 251*a* for monitoring the pressure in the tank. In the shown embodiment, the air pressure in the reservoir tank 221 is adjusted to about 2.5 to 3.5 kg/cm$^2$. By the internal air pressure of the reservoir tank 221, the cleaning agent in the reservoir tank 221 is forced to flow through the cleaning agent feeding tube 227, the filter 230 and tube 231. The tube 231 is connected to the fuel feed tube 206 via the coupler 232. Therefore, the cleaning agent flowing through the cleaning agent feeding tube 227 flows through the fuel feed tube 206, the gallery 207 to the fuel injection valves 208.

Likewise to the foregoing second embodiment, the gallery 207 is disconnected from the pressure regulator 209 and applied plugs 243 at both ends thereof. Therefore, the cleaning agent feeding tube 227 serves as a return tube as the pressure in the tank is dropped.

In cleaning operation, first, the compressor 251 is driven to feed pressurized air to the reservoir tank 221. By this, internal pressure in the reservoir tank 221 is increased at about 2.5 to 3.5 kg/cm$^2$. In this manner, the cleaning agent in the reservoir tank 221 is forced to circulate through the cleaning agent feeding tube 227, the filter 230 and the fuel feeding tube 206 to the fuel injection valves 208. In this condition, the engine is driven similarly to the foregoing embodiment to effect solvent cleaning of gums, sludge and so on.

Figure 14:
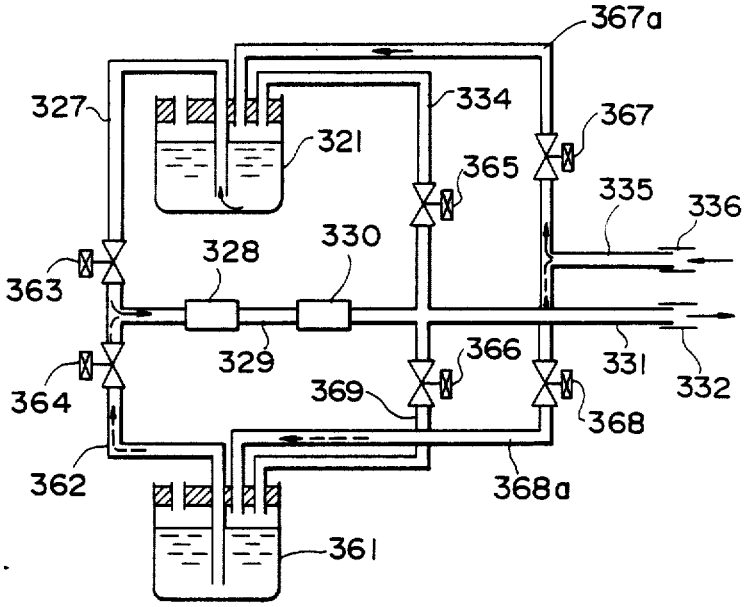
FIG. 14 is a schematic circuit diagram of the fourth embodiment of the cleaning device.
Figure 15:
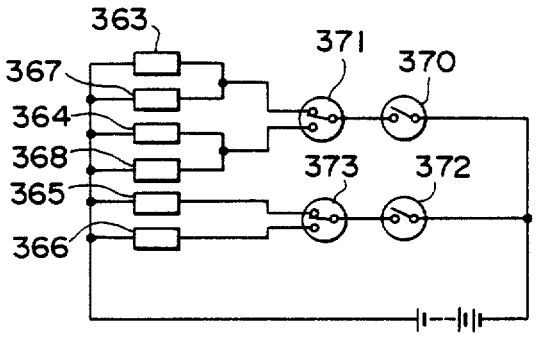
FIG. 15 is an electric circuit diagram of an actuation circuit for electromagnetic valves applied in the fourth embodiment of FIG. 14.

FIGS. 14 and 15 show the fourth embodiment of the cleaning device according to the present invention. In this embodiment, the reservoir tank 321 is filled with the cleaning agent and the reservoir tank 361 is filled with gasoline used as normal fuel. The reservoir tank 321 is connected to the feeding pump 328 through a tube 327 and via an electromagnetic valve 363. On the other hand, the reservoir tank 361 is connected to the feeding pump 328 through a tube 362 and via an electromagnetic valve 364. The feeding pump 328 is connected to the filter 330 via tube 329. The filter 330 is connected to the fuel feeding tube 306 through a feeding tube 331 and the coupler 332. The filter 330 is, in turn, connected to the reservoir tank 321 via an electromagnetic valve 365 and tube 334. The filter 330 is further connected to the reservoir tank 361 via an electromagnetic valve 366 and the tube 369.

The reservoir tank 321 is connected to the fuel return tube 310 via an electromagnetic valve 367 and return tube 367*a*. Likewise, the reservoir tank 361 is connected to the fuel return tube 310 via an electromagnetic valve 368 and the return tube 368*a*. The tube 335 and the coupler 336 are interpositioned between the fuel return tube 310 and the tubes 367*a* and 368*a*.

FIG. 15 shows the actuation circuit of the electromagnetic valves 363, 364, 365, 366, 367 and 368. As seen from FIG. 15, the electromagnetic valves 363 and 367 are arranged in parallel to each other with respect to the vehicle battery 338. Likewise, the electromagnetic valves 364 and 368 are arranged in parallel relationship with respect to one another. Further the electromagnetic valves 365 and 366 are also arranged in parallel relationship with respect to the vehicle battery 338. Furthermore, the electromagnetic valves 363 and 367 are arranged in parallel relationship with the electromagnetic valves 364 and 368 with respect to switches 371 and 370. The switch 371 is adapted to selectively complete one of actuation circuit for the electromagnetic valves 363 and 367 and the actuation circuit for the electromagnetic valves 364 and 368.

On the other hand, the switch 373 is adapted to selectively activate the electromagnetic valves 365 and 366. Since the electromagnetic valves 365 and 366 are adapted to relief the pressure in the cleaning agent feeding circuit, the electromagnetic valves must be activated to open while the pump 328 is not driven. Further, since the electromagnetic valves 365 and 366 are selected to open in relation to the circuit to feed either of the cleaning agent or the gasoline, the switches 371 and 373 cooperatively operate. The switch 270 is preferably associated with the pump 328 and is turned on while the pump is driven to open the valves. In turn, the switch 272 is adapted to be turned on while the pump is not driven and after the switch 270 is turned off In the cleaning operation, the switches 371 and 373 are respectively turned at the position as shown in FIG. 15. At this switch position, the electromagnetic valves 363, 367 are activated to open the valves as long as the switch 370 is turned on. By this, the circuit for feeding the cleaning agent is completed. At the same time, the pump 328 is started to drive the cleaning agent sucked from the reservoir tank 321 to the fuel injection valve via the filter 330, the tube 331, the fuel feeding tube 306 and the gallery (not shown). Then, the engine is driven to effect solvent cleaning of gums, sludge and so on adhering on the fuel injection valve as set forth in the foregoing embodiments.

The remaining cleaning agent in the feeding circuit is returned through the pressure regulator (not shown) connected to the gallery, the fuel returning tube (not shown), the return tube 335, the electromagnetic valve 367 to the reservoir tank 321.

After this cleaning operation, the switch 370 is turned off and the switch 372 is then turned on. Thus, the electromagnetic valve 365 is activated to open the circuit for relieving the cleaning agent pressure in the cleaning agent feeding circuit. The switch 372 is kept at on position for the predetermined period, e.g., 1 sec. to complete relief of the cleaning agent pressure. After this, the switches 371 and 373 are turned to the opposite the position shown in FIG. 15. By this, the electromagnetic valves 364 and 368 are activated to open the valves to complete the circuit for feeding gasoline from the reservoir tank 361 as long as the switch 370 is turned on. At the same time, the pump 328 is driven again to suck the gasoline in the reservoir tank 361 and energize the same to circulate through the feeding circuit therefor. Thus, gasoline is fed to the fuel injection valves. By driving of the engine, the gasoline is injected into the induction system of the engine and remained gasoline is returned through the pressure regulator, the fuel return tube, the return tube 35 and the electromagnetic valve 368 to the reservoir tank 361. By this, the cleaning agent in the feeding circuit is completely removed. After driving the engine for the predetermined period, e.g., 10 min. The switch 370 is turned off and then the switch 372 is turned on to open the electromagnetic valve 366. By this, the pressure in the feeding circuit is dropped to the atmospheric pressure.

According to this fourth embodiment, the feeding of the cleaning agent, performing the solvent cleaning, and removing of the cleaning agent is conveniently performed by one operation. Further, it will be more convenient to use the switch 370 responsive to the level of the cleaning agent in the reservoir tank 321. The switch of cleaning level sensitivity will comprises a relay switch cooperated with a float member disposed within the reservoir tank 321 and movable according to the change of the cleaning agent level. The float will go down according to consumption of the cleaning agent and then turn off the relay switch at a predetermined cleaning agent level.

Figure 16:
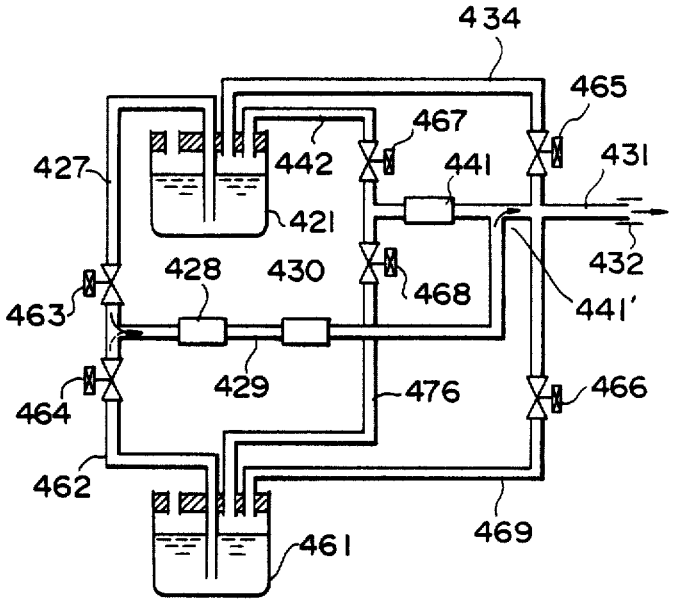
FIG. 16 is a schematic circuit diagram of the fifth embodiment of the cleaning device.

FIG. 16 shows the fifth embodiment of the cleaning device as the modification of the foregoing forth embodiment of the present invention. In the shown fifth embodiment, the feeding and returning of the cleaning agent to and from the fuel feeding circuit is done by a common tube 431. In this embodiment, the reservoir tanks 421 and 461 respectively filled with the cleaning agent and gasoline are provided. The cleaning agent reservoir tank 421 is connected to the common tube 431 via the suction tube 427, the electromagnetic valve 463, the common electric pump 428, the common feeding tube 429 and the filter 430. On the other hand, the gasoline reservoir tank 461 is connected to the common tube via the suction tube 462, the electromagnetic valve 464, the electric pump 428, the feeding tube 429 and the filter 430. The electromagnetic valves 463 and 464 are activated alternatively for establishing communication between one of the reservoir tanks 421 and 461 to the common tube 431. The common tube 431 is, in turn, connected to the reservoir tanks 421 and 461 via pressure relief tubes 442 and 476 respectively with the electromagnetic valves 467 and 468.

The pressure regulator valve 441 is inserted in the common tube 431 at the position intermediate between the electromagnetic valves 467 and 468 and the connecting point 441' with the feeding tube 429. The pressure regulating valve 441 regulates the pressure of the cleaning agent or the gasoline in the feeding circuit at the predetermined valve, i.e., about 2.5 kg/cm$^2$. If the fluid pressure in the feeding circuit exceeds the predetermined value, the pressure regulator valve 441 is opened until the pressure drops at the predetermined value to maintain the fluid pressure at the predetermined level.

The operation of the shown cleaning device is similar to that of the cleaning device as set forth in the fourth embodiment. The only difference is the returning of the cleaning agent and gasoline which is done by the common tube 431 by regulating the fluid pressure.

In order to effect a similar function to that of the fourth embodiment, the electromagnetic valves 467 and 468 are respectively cooperated with the electromagnetic valves 463 and 464 to be operated corresponding to the valve position of the latters.

By this, the cleaning device construction of the fourth embodiment can be simplified.

Figure 17:
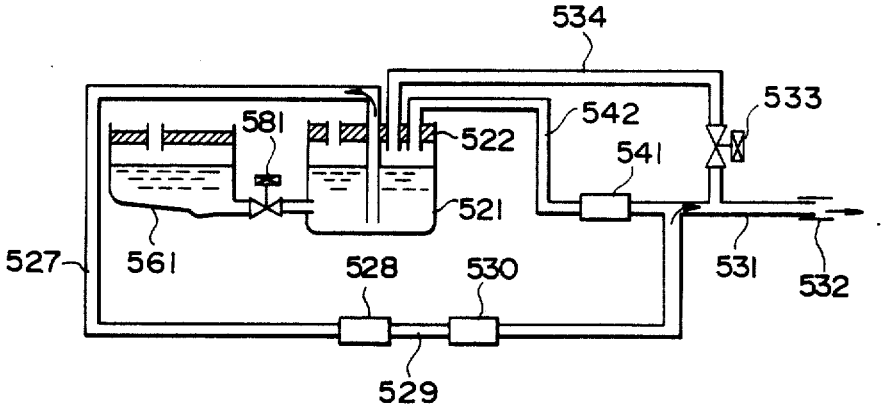
FIG. 17 is a schematic circuit diagram of the sixth embodiment of the cleaning device.

FIG. 17 shows the sixth embodiment of the cleaning device according to the present invention. In this embodiment, two reservoir tanks 521 and 561 are communicated with each other through a valve 581. The reservoir tank 521 is filled with the cleaning agent as set forth in the foregoing embodiments and, in turn, the reservoir tank 561 is filled with gasoline. After solvent cleaning, the valve 581 is opened to introduce the gasoline in the reservoir tank 561 to the reservoir tank 521 for dilution of the cleaning agent with gasoline.

As shown in FIG. 17, the reservoir tank 521 is connected to the electric pump 528 via the suction tube 527. The electric pump is, in turn, connected to the fuel feeding circuit via the cleaning agent feeding tube 531 with coupler 532. The return tube 542 with the pressure regulating valve 541 is connected to the feeding tube 531 for regulating the cleaning agent pressure in the feeding circuit at the predetermined value, i.e., approximately 2.5 kg/cm$^2$. Also, the pressure relief valve is connected to the feeding tube 531 and, in turn, to the reservoir tank 521 via the relief tube 534.

In this construction, the valve 581 is closed while the solvent cleaning for the fuel injection valves is performed. In the solvent cleaning, therefore, the cleaning agent including the aromatic solvent at the predetermined mixture rate is fed to the fuel feeding circuit of the engine through the electric pump 528 and the filter 530. Then, the engine is driven for the given period of time, i.e., 10 min. for effect injection of the cleaning agent through the fuel injection valves to carry out solvent cleaning thereby. After completing cleaning operation, the valve 581 is opened to introduce the gasoline to dilute the cleaning agent with gasoline gradually. At this position, the electric pump 528 is driven again and the engine is driven. By this, diluted cleaning agent is injected through the fuel injection valve, in which the mixture rate of the aromatic solvent is gradually reduced. Therefore, even during removing process of the cleaning agent, solvent cleaning is still performed for further completing the cleaning operation.

In the shown embodiment, the reservoir tank 521 may be of a size for receiving the cleaning agent at an amount equal to or slightly exceeding the amount to be consumed during the cleaning operation. Therefore, it would be appreciated that the reservoir tank 521 of this embodiment can be smaller than that of the counterpart in the preceding embodiments.

It would be possible to modify the foregoing sixth embodiment to switch open and close the valve 581 automatically. In order to achieve the automatic switching function, a float may be applied in the reservoir tank 521 to detect the cleaning agent level in the reservoir tank 521, and the valve 581 may comprises an electromagnetic valve responsive to the signal from said float means. In this case, it would not be necessary to cease driving of the electric pump 528 and the engine even when the solvent cleaning period expires. Therefore, the modification as set forth will a provide more convenient cleaning operation in comparison with the foregoing sixth embodiment.

Figure 18:
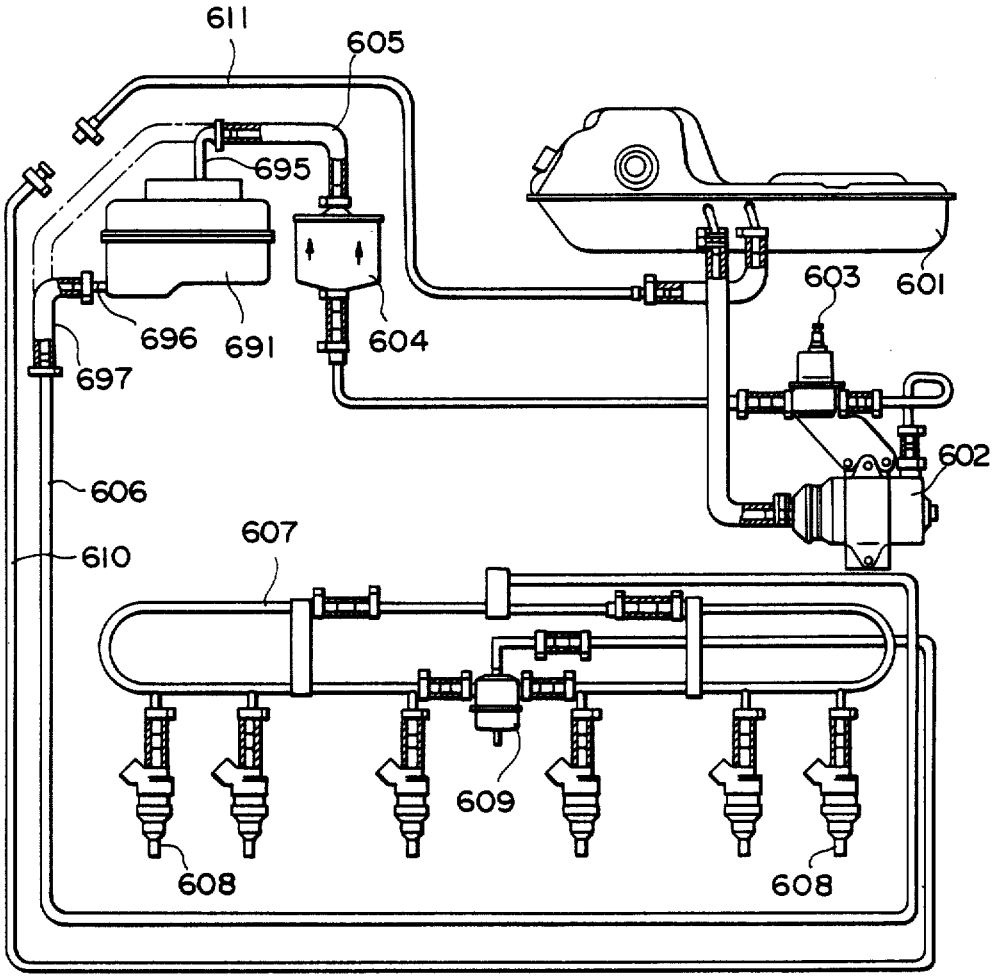
FIG. 18 is a diagrammatic illustration showing the fuel supply system including the seventh embodiment of the cleaning device.
Figure 19:
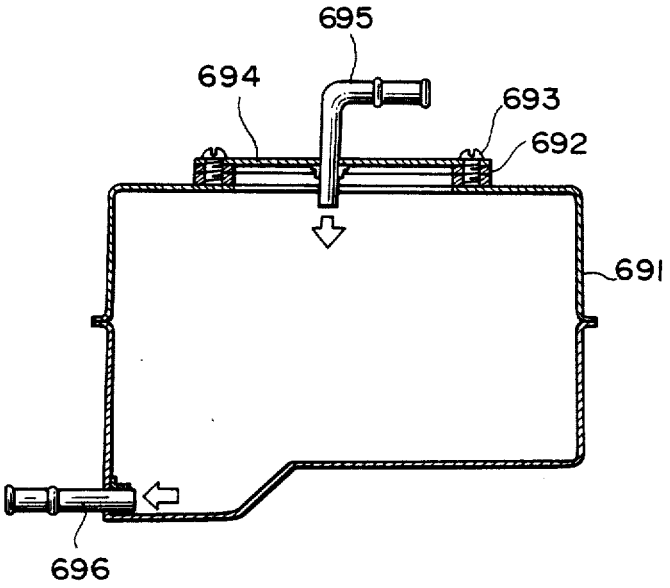
FIG. 19 is a sectional view of a tank in the seventh embodiment of FIG. 19.

FIGS. 18 and 19 show the seventh embodiment of the cleaning device according to the present invention. In this seventh embodiment, the tank 691 is inserted in the fuel feeding circuit of the engine.

As shown in FIG. 18, the tank 691 is connected to the fuel feeding tube 5 downstream of the filter 604, at the inlet port 695. The outlet port 696 of the tank 691 is connected to the gallery 607 of the fuel feeding circuit via a flexible hose 697 and the fuel feeding tube 606. This hose 697 will not always be necessary and, therefore can be neglected if the fuel feeding tube 606 can be connected to the outlet port 696 with some appropriate coupler. The fuel return tubes 610 and 611 are disconnected from each other and disconnecting ends thereof are plugged respectively. By this, the cleaning agent in the tank 691 will never recirculated to the fuel tank 601.

In the embodiment shown, the initial concentration of the aromatic solvent in the cleaning agent is substantially higher than that preferred in the preceding embodiments. In test, the ratio of the aromatic solvent and gasoline at approximately 1:3 is preferred. This initial mixture rate will be reduced to about 1/15 to 1/20 during the solvent cleaning operation in which gasoline in the fuel tank 601 is introduced into the tank 691 for pressurizingly circulating the cleaning agent.

In the operation, the fuel pump 602 is driven to suck the fuel in the fuel tank 601 and to feed the gasoline to the fuel feeding circuit through the fuel damper 603. This gasoline is fed to the tank 691 via the filter 604 to increase the fluid pressure in the tank 691. In this result, the cleaning agent in the tank 691 is forced to circulate through the fuel feeding tube 606 to the fuel injection valve. By driving of the engine leading the operation of the fuel pump, the cleaning agent fed to the fuel injection valves 608 via the gallery 607 is injected into respective combustion chamber of the engine to be burnt therein. While the cleaning agent is injected through the fuel injection valves, gums, sludges and so on adhering onto the fuel injection valves are dissolved in the cleaning agent. The cleaning agent including the dissolved gums, sludge and so on is burnt in the combustion chamber.

As shown in FIG. 19, the tank 691 has an opening in the top thereof. The opening is closed with a closure 694 with an annular elastic sealier 693. The closure 694 is fixed onto the edge of the opening with a plurality of fixing screws 692 which sandwich the sealer 693 between the lower surface thereof and the top of the opening edge. By this, an air-tight closure can be established for preventing the interior of the tank from dropping pressure upon introduction of gasoline.

The following tables are the result of experimental solvent cleaning operations in use with the cleaning device of the seventh embodiment. For the experiment a 6-cylinder, 2800 cc engine, the so-called Datsun L28E engine is used. In the tank 691, the cleaning agent having a mixture ratio of gasoline to aromatic solvent of 3:1 is used. The engine is driven for 10 min. at the engine speed 2,000 r.p.m. under a no load condition. The items shown in the following tables 3 and 4 is the same as that of the table 1 as set forth.

TABLE 3

| Cylinder | Before Cleaning | | After Cleaning | |
|---|---|---|---|---|
| No. | Static | Dynamic | Static | Dynamic |
| 1 | −17.0 (%) | −17.4 (%) | −4.4 (%) | −6.3 (%) |
| 2 | −16.0 | −18.0 | −0.1 | −1.9 |
| 3 | −17.9 | −21.1 | −0.5 | −0.7 |
| 4 | −18.4 | −16.1 | −2.6 | −1.8 |
| 5 | −16.8 | −16.1 | −2.2 | −0.4 |
| 6 | −14.3 | −11.7 | −2.1 | −2.0 |
| Average | −16.7 | −16.7 | −2.0 | −2.2 |

TABLE 4

| Item | Before Cleaning | After Cleaning |
|---|---|---|
| Static Flow Amount | −18.4 to −14.3(%) (average −16.7%) | −4.4 to −0.1(%) (average −2.0%) |
| $CO + CO_2$ (%) | 12.34% | 13.85% |

The foregoing embodiments are adapted such as to disconnect the fuel feeding circuit and connect the cleaning device to the disconnected fuel feeding circuit; however, it would be possible to provide the fuel feeding system with a connector and valves for connecting the cleaning device on assembling the system. This may be convenient for performing solvent cleaning of the fuel injection valve.

Figure 20:
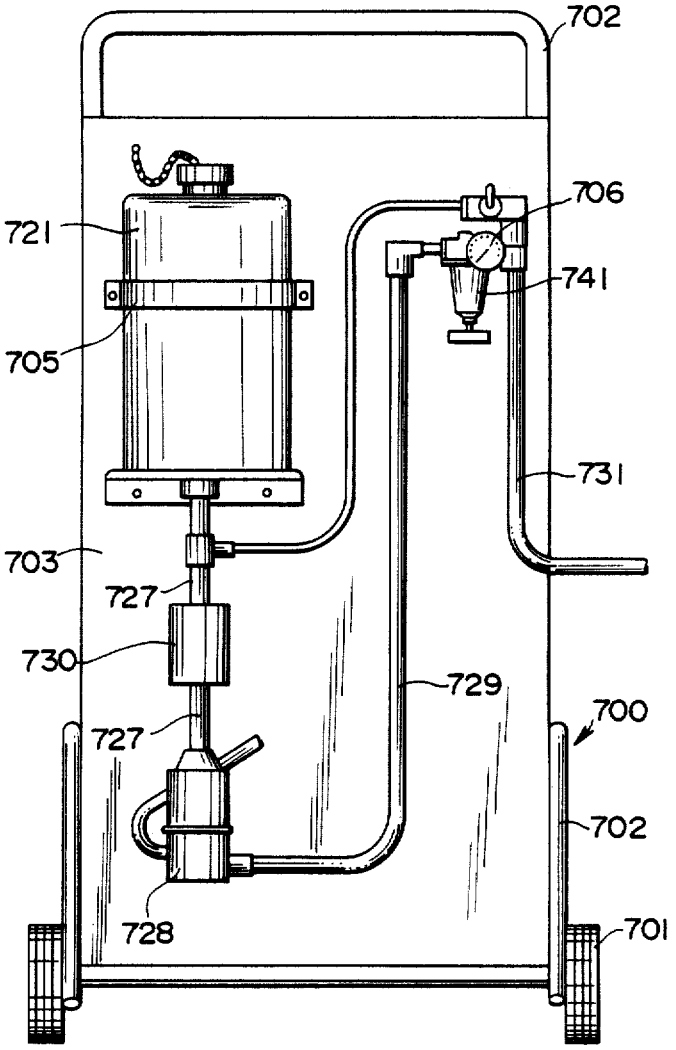
FIG. 20 is a front elevation of the eighth embodiment of the cleaning device.

FIG. 20 shows the eighth embodiment of the cleaning device. In this embodiment, the cleaning device is mounted on a carrier 700 with casters 701 and a handle 702. A support panel 703 is fixed to the carrier frame. A bracket 704 is secured onto the support panel 703 to mount thereof the reservoir tank 721. A fixing belt 705 is wound around the reservoir tank 721 and fixed at both ends thereof to the support panel 703 for fixing the reservoir tank 721 onto the support panel 703. The electric pump 728 is located below the reservoir tank 721 and mounted on the support panel 703 with a bracket (not shown). The electric pump 728 is connected to the reservoir tank 721 through the suction tube 727 and the filter 730. The suction tube 727 is inserted into the reservoir tank 721 through the bottom of the tank. The pressure regulator 741 is also secured onto the support panel 703 and is connected to the electric pump 728 via the cleaning agent feeding tube 729. The pressure regulator 741 includes a pressure indicator 741'. The pressure regulator 741 is connected to feeding tube 731 to be connected the fuel feeding circuit of the engine. At the downstream of the pressure regulator 741, there is provided the pressure relief cock valve 733 with pressure relief tube 734. The pressure relief valve 733 is connected to the feeding tube 731 to drop the fluid pressure in the cleaning agent feeding circuit at the end of cleaning operation before disconnecting the cleaning device from the fuel feeding circuit.

As will be appreciated, the feeding circuit construction of this eighth embodiment is similar to that of the second embodiment as set forth. By this embodiment, the cleaning device can be conveniently carried and moved.

While the present invention has been described in detail with reference to the accompanying drawings of the preferred embodiments, it would be possible to modify any of the embodiments.

What is claimed is:

1. A cleaning device for a fuel injection valve in a fuel injection internal combustion engine, comprising:

a fuel supply system for supplying fuel for driving the engine, said fuel supply system including a fuel injection valve for injecting said fuel to an induction system of the engine;

a cleaning agent supply system which supplies a cleaning agent through said fuel supply system to said fuel injection valve, which cleaning agent is adapted for dissolving gums, sludge and other adherents on said fuel injection valve and for combustion in said engine; and means for releasably connecting said cleaning agent supply system to said fuel supply system when the cleaning operation is carried out;

wherein said cleaning agent comprises a mixture of gasoline and additives, said additives are comprised of 75 to 60 volume percent of aromatic solvent and 15 to 40 percent of water.

2. A cleaning device as set forth in claim 1, wherein said aromatic solvent is composed of fatty acid, calcium-sulfonate, butyl-cellosolve and aromatic hydrocarbon.

3. A cleaning device as set forth in claim 1, wherein said additives are mixed with the gasoline at a mixture rate 1:6 to 1:18.

* * * * *